US010583651B2

(12) United States Patent
Ko et al.

(10) Patent No.: US 10,583,651 B2
(45) Date of Patent: Mar. 10, 2020

(54) DROPLET DEPOSITION HEAD

(71) Applicant: XAAR TECHNOLOGY LIMITED, Cambridge (GB)

(72) Inventors: Song-Won Ko, Cambridge (GB); Peter Mardilovich, Cambridge (GB); John Philip Tatum, Cambridge (GB); Alexandru Cazacu, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/072,559

(22) PCT Filed: Dec. 22, 2016

(86) PCT No.: PCT/GB2016/054036
§ 371 (c)(1),
(2) Date: Jul. 25, 2018

(87) PCT Pub. No.: WO2017/129933
PCT Pub. Date: Aug. 3, 2017

(65) Prior Publication Data

US 2019/0030885 A1 Jan. 31, 2019

Related U.S. Application Data

(60) Provisional application No. 62/288,287, filed on Jan. 28, 2016.

(51) Int. Cl.
*B41J 2/045* (2006.01)
*B41J 2/16* (2006.01)
*B41J 2/14* (2006.01)

(52) U.S. Cl.
CPC ..... *B41J 2/04505* (2013.01); *B41J 2/04573* (2013.01); *B41J 2/04581* (2013.01);
(Continued)

(58) Field of Classification Search
CPC ..... B41J 2/04573; B41J 2/04581; B41J 2/14201; B41J 2/14209; B41J 2/14233;
(Continued)

(56) References Cited

U.S. PATENT DOCUMENTS 5,677,717 A 10/1997 Ohashi
6,926,572 B2 8/2005 Park et al.
(Continued)

FOREIGN PATENT DOCUMENTS

CN 1481994 A 6/2006
CN 102673150 A 9/2012
(Continued)

OTHER PUBLICATIONS

Bülow et al., Moisture barrier properties of thin organic-inorganic multilayers prepared by plasma-enhanced ALD and CVD in one reactor, Nanoscale Res. Lett., 9(1):223 (May 2014).
(Continued)

*Primary Examiner* — Juanita D Jackson
(74) *Attorney, Agent, or Firm* — Finnegan, Henderson, Farabow, Garrett & Dunner LLP

(57) ABSTRACT

A droplet deposition head having a fluid chamber connected to a droplet ejection nozzle and to a reservoir for the fluid, and a piezoelectric actuator element formed at least in part by a fluid chamber wall having an electrode thereon, which element is displaceable in response to a drive voltage to generate a pressure in the chamber to eject a droplet of fluid from the chamber through the nozzle wherein the electrode is provided with a passivation coating which comprises, at least in part, a laminate comprising an inorganic insulating layer nearest to or contacting the electrode and an organic insulating layer overlying the inorganic insulating layer wherein defects in the insulating layers tend to be misaligned at the interface there between and wherein the
(Continued)

inorganic insulating layer has thickness less than or equal to 500 nm and the organic insulating layer has a thickness less than 3 μm.

20 Claims, 8 Drawing Sheets

(52) U.S. Cl.
CPC ..... *B41J 2/14201* (2013.01); *B41J 2/14209* (2013.01); *B41J 2/164* (2013.01); *B41J 2/1607* (2013.01); *B41J 2/1609* (2013.01); *B41J 2/1642* (2013.01); *B41J 2002/14225* (2013.01)

(58) Field of Classification Search
CPC .... B41J 2/14274; B41J 2/1607; B41J 2/1609; B41J 2/1641; B41J 2/1642; B41J 2/04505; B41J 2/16; B41J 2/14225
See application file for complete search history.

(56) References Cited

U.S. PATENT DOCUMENTS

| | | | | |
|---|---|---|---|---|
| 8,240,819 | B2 | 8/2012 | Seki | |
| 8,647,722 | B2 | 2/2014 | Kobayashi et al. | |
| 8,960,857 | B1 | 2/2015 | Sung et al. | |
| 2001/0052752 | A1 | 12/2001 | Ghosh et al. | |
| 2004/0032466 | A1 | 2/2004 | Deguchi et al. | |
| 2010/0238237 | A1 | 9/2010 | Seki | |
| 2010/0245475 | A1* | 9/2010 | Masashi et al. | 347/45 |
| 2012/0236083 | A1* | 9/2012 | Mizukami et al. | 347/70 |
| 2013/0250005 | A1 | 9/2013 | Koyata et al. | |

FOREIGN PATENT DOCUMENTS

| | | | |
|---|---|---|---|
| CN | 103317851 | A | 9/2013 |
| EP | 0364136 | B1 | 8/1994 |
| EP | 0646464 | A2 | 4/1995 |
| EP | 0719213 | B1 | 8/1998 |
| EP | 2502747 | A1 * | 9/2012 |
| EP | 2502747 | A2 | 9/2012 |
| EP | 1885561 | B1 | 7/2013 |
| KR | 20150066205 | A | 6/2015 |

OTHER PUBLICATIONS

Great Britain Application No. GB1608902.1, Combined Search and Examination Report under Sections 17 & 18(3), dated Jul. 19, 2016.
International Application No. PCT/GB2016/054036, International Search Report and Written Opinion, dated Mar. 27, 2017.
First Office Action dated Oct. 24, 2019, from the State Intellectual Property Office of People's Republic of China for counterpart Chinese Application No. 201680080523.9 and an English-language translation thereof (17 pages).

* cited by examiner a)

b)

DROPLET DEPOSITION HEAD

The present disclosure is concerned with a droplet deposition head comprising a piezoelectric bulk body defining fluid chambers wherein the fluid chambers include electrodes which have an improved passivation coating as compared to those in similar existing droplet deposition heads.

The present disclosure is also concerned with a droplet deposition apparatus including the droplet deposition head as well as a method for the manufacture of the droplet deposition head and the droplet deposition apparatus.

A variety of alternative fluids may be deposited by a droplet deposition head. For instance, a droplet deposition head may eject droplets of ink that may travel towards a receiving medium, such as a ceramic tile or shaped articles (e.g. cans, bottles etc.), to form an image, as is the case in inkjet printing applications (where the droplet deposition head may be an inkjet printhead or, more particularly, a drop-on-demand inkjet printhead).

Alternatively, droplets of fluid may be used to build structures, for example electrically active fluids may be deposited onto receiving media such as a circuit board so as to enable prototyping of electrical devices.

In another example, polymer containing fluids or molten polymer may be deposited in successive layers so as to produce a prototype model of an object (as in 3D printing).

In still other applications, droplet deposition heads might be adapted to deposit droplets of solution containing biological or chemical material onto a receiving medium such as a microarray.

Droplet deposition heads suitable for such alternative fluids may be generally similar in construction to printheads, with some adaptations made to handle the specific fluid in question.

Droplet deposition heads as described in the following disclosure may be drop-on-demand droplet deposition heads. In such heads, the pattern of droplets ejected varies in dependence upon the input data provided to the head.

Drop-on-demand head actuators comprise actuator elements that are configured to act upon individual fluid chambers to effect droplet ejection. The actuator element may be a thermal or a piezoelectric element, for example. In each case the actuator material is addressed by electrodes to cause either rapid heating of a resistor-type actuator element in the case of a thermal actuator element, or mechanical deformation in the case of piezoelectric actuator elements.

Different configurations of piezoelectric actuator elements may be used. One configuration uses actuator elements formed from a continuous sheet of piezoelectric material into which parallel grooves are sawn to form longitudinal fluid chambers.

One such configuration, providing a "side shooter" droplet deposition head is described in EP 0 364 136 B1, and references therein, and shown in FIG. 1.

The droplet deposition head (FIG. 1) includes a plurality of fluid chambers 110 arranged side-by-side in an array. This array extends from left to right in the Figure. Each of the fluid chambers 110 are provided with a nozzle 172, from which fluid contained within the fluid chamber 110 may be ejected, in a manner that will be described below. Each of the fluid chambers 110 is elongate in a chamber length direction, and perpendicular to the array direction.

Adjacent chambers 110 within the array are separated by chamber walls 130, which are formed of piezoelectric material (such as lead zirconate titanate (PZT), however any suitable piezoelectric material may be used). One longitudinal side of each of the fluid chambers 110 is bounded (at least in part) by a nozzle plate 170, which provides a nozzle 172 for each of the chambers 110. It will be appreciated that other approaches may achieve this as well: a separate nozzle plate 170 component is not required in order that each nozzle 172 is provided in one longitudinal side of the corresponding one of the firing chambers 110.

The other, opposing, longitudinal side of each of the fluid chambers 110 is bounded (at least in part) by a substrate 180, which may, for example, be substantially planar. In some arrangements, the substrate 180 may be integral with a part of, or all of, each of the walls 130. Hence (or otherwise) the substrate 180 may be formed of piezoelectric material. It should also be appreciated that an interposer layer could be provided between the walls 130 and the nozzle plate 170; this interposer layer may, for example, provide a respective aperture for each of the nozzles 172 of the nozzle plate. Such apertures may be wider than the nozzles 172, so that the fluid contacts only the nozzles 172 during droplet ejection.

Each wall 130 is provided with a first electrode 151 and a second electrode 152. In more detail, prior to attaching the nozzle plate 170 to the walls 130, a continuous layer of conductive material is deposited, for example simultaneously, over the surface of the substrate 180 and also over surfaces of the fluid chambers. Appropriate electrode materials may include copper, nickel and gold, either used alone or in combination. The deposition may be carried out by an electroplating process, electroless processes (for example utilising palladium catalyst to provide the layer with integrity and to improve adhesion to the piezoelectric material), or by physical vapour deposition processes.

Subsequently, a laser beam is directed at the workpiece including the substrate 180 and the wall 130. The laser is then moved so that the point where its beam impacts the workpiece moves along a path at the centre of the top surface of the walls 130 for the whole length of the substrate 180 in the chamber length direction. The laser beam vaporises conductive material along this path and this action results in the conductive material being patterned and the metal layer being divided into separate electrodes, one on each side surface of the walls 130 as shown in FIG. 1.

The first electrode 151 is disposed on a first side surface of the wall 130, which faces towards one of the two fluid chambers 110 that the wall 130 in question separates, whereas the second electrode 152 is disposed on a second side surface of the wall 130, which is opposite the first side surface and faces towards the other of the two fluid chambers 110 that the wall 130 in question separates. The first 151 and second 152 electrodes for the wall 130 are configured to apply a drive voltage waveform to the wall 130. Each wall 130 includes a first portion 131 and a second portion 132, with the respective piezoelectric material being poled in opposite direction to each other. The poling direction of each of the first portion 131 and the second portion 132 is perpendicular to the array direction and to the chamber length direction. The first 131 and second 132 portions are separated by a plane defined by the array direction and the chamber length direction.

As a result of the above arrangement, when a drive voltage waveform is applied to the wall 130 by the first 151 and second 152 electrodes, the wall 130 deforms in a chevron configuration, whereby the first 131 and second 132 portions deform in shear mode in opposite senses, as is shown in dashed-line in FIG. 2.

Such deformation causes an increase in the pressure of the fluid within that one of the two fluid chambers 110. The deformation also causes a corresponding reduction in the pressure of the other one of the two fluid chambers 110. It will be appreciated that a drive waveform of opposite polarity will cause the wall 130 to deform in the opposite direction, thus having substantially the opposite effect on the pressure of the fluid within the two chambers 110 separated by the wall 130. Where the magnitude of the pressure exceeds a certain level, droplets of fluid 105 may be ejected from the nozzle 172 of a chamber 110. The wall 130 may be driven by the drive waveform such that it deforms alternately toward one of the two fluid chambers 110 it separates and toward the other. Thus, the wall 130 may be caused by the drive waveform to oscillate about its undeformed position (though it will be appreciated that such cyclical deformation is by no means essential: the drive waveform could instead cause non-cyclical deformations of the wall). A 3-cycle firing scheme is shown in FIG. 2 but many other firing schemes are possible.

It should of course be appreciated that deformation in chevron configuration may be achieved with different arrangements of the wall 130 and the first 151 and second 152 actuation electrodes. For example, the piezoelectric material of the wall may be poled substantially in only one direction, a wall height direction. The first 151 and second 152 electrodes may be arranged such that they extend over only a portion of the height of the wall 130 in this height direction (more particularly, they may extend over substantially the same portion of the height of the wall 130 in this height direction).

Another such configuration, providing an "end shooter" droplet deposition head is described in EP 1 885 561 B1, and references therein, and shown in FIGS. 3 and 4. In this arrangement each nozzle 272 is provided at the longitudinal end of a firing chamber 210.

FIG. 3 (*a*) shows a perspective, exploded view of the droplet deposition head 200, which, as in the droplet deposition head of FIG. 1, includes a plurality of fluid chambers 210 arranged side-by-side in an array formed in a base 281 of piezoelectric material (such as lead zirconate titanate (PZT), however any suitable piezoelectric material may be used). The grooves formed in the base 281 comprise a forward part in which they are comparatively deep to provide elongate fluid chambers 210 separated by opposing walls 230, being formed of the piezoelectric material of the base 281. The grooves in the rearward part are comparatively shallow to provide locations for connection tracks.

After forming the grooves, metallized plating is deposited, as described above, in the forward part providing electrodes 251 and 252 on the side surfaces of the walls in the forward part of each groove. In the rearward parts of the grooves, the metallized plating provides conductive tracks 255*a*, 256*a* that are connected to electrodes 251-252 for the fluid chambers 210.

The base 281 is mounted as shown in FIG. 3 (*a*) on the circuit board 282 and bonded wire connections are made connecting the conductive tracks 255*a*, 256*a* on the base 281 to the conductive tracks 255*b*, 256*b* on the circuit board 282. These tracks 255, 256 may electrically connect the actuation electrodes 151, 152 to ground or to voltage signals.

A cover plate 275, which is bonded during assembly to the base 281, is shown above its assembled location. A nozzle plate 270 is also shown adjacent the base 281, spaced apart from its assembled position.

In the assembled droplet deposition head 200, in FIG. 3 *b*), the cover 275 is secured by bonding to the tops of the walls 130, thereby forming a multiplicity of closed, elongate fluid chambers 210 having access at one end to the window 276 in the cover plate 275 which provides a manifold for the supply of replenishment fluid. The nozzle plate 270 is attached, for example by bonding, at the other end of the fluid chambers 210. The nozzles 272 maybe formed at locations in the nozzle plate 270 corresponding with each fluid chamber, for instance by UV excimer laser ablation. The nozzles 272 are thus each provided at a longitudinal end of the corresponding one of the fluid chambers 210.

During use of the droplet deposition head 200, fluid is drawn into the fluid chambers 210 through the window 276 in the cover plate 275.

FIG. 4 is a plan view in the chamber length direction of a cross-section through the droplet deposition head 200. Each of the fluid chambers 210 is provided with a nozzle 272 for droplet ejection and walls 230, which may be actuated to cause droplet ejection by a first electrode 251 and a second electrode 252 that are configured to apply a drive waveform to the walls 230, which are thereby deformed. The piezoelectric material of each of the chamber walls 230 is poled generally only in one direction, which is perpendicular to the array direction.

As may be seen from the dashed-lines in the drawing, the drive waveform causes the wall 230 to deform in shear mode towards one of the two fluid chambers 210 that it separates. The electrical field, that is generally oriented in the array direction, is generally strongest over the portion of the height of the wall that the electrodes 251, 252 extend over. This causes that portion of the wall 230 to deform in shear mode; however, this portion of the wall also applies a mechanical force to the portion of the wall connected to it, the bottom portion of the wall, "pulling" said portion with it. This results in the wall 230 deforming in chevron configuration, with similar effects that those already described above. It should of course be appreciated that deformation in chevron configuration may be achieved with different arrangements of the wall 230 and the first 251 and second 252 actuation electrodes. For example, each of the walls might include a first portion and a second portion poled in an opposite direction to each other, with the electrodes extending over the entire height of the wall, as already described above. It will be appreciated that the droplet deposition head 200 can be operated in substantially the same way as described above for the droplet deposition head 100.

The metal electrodes in these droplet deposition heads are in direct contact with fluids and so are susceptible to electrolysis and bubble formation or corrosion. This can lead to delamination of the electrodes and/or short operational lifetime for the droplet deposition head especially if the fluid is aqueous.

A passivation coating is, therefore, usually provided on the electrodes and on the surfaces of the piezoceramic body in contact with the fluid, in particular, on the chamber walls of each chamber.

In general, the passivation coatings comprise single or multiple insulating layers of a fluid barrier material which can be deposited at a sufficiently low temperature to avoid de-poling of the piezoceramic body and with a high degree of conformality to the surfaces.

The fluid barrier material may be an organic material, and in particular an organic polymer such as a parylene—but it may also be an inorganic material such as amorphous silicon nitride or oxide.

The droplet deposition head disclosed in EP 1 885 561 B1, for example, includes a passivation coating on the metal electrodes comprising a single layer of a parylene.

EP 0 719 213 B1 discloses a method for passivating the fluid chamber walls and electrodes in an inkjet printhead such as that described in EP 0 364 136 B1. The method employs a low temperature vapour deposition of one or more inorganic layers which is said to provide faster and more even passivation when the vapour is homogenised by the attainment of a uniform distribution of its chemical constituents.

Nonetheless, one problem that remains from the requirement for low temperature deposition of passivation coatings is that there is significant variation in the coverage of the coating on the fluid chamber walls and/or electrode surfaces.

The variation in coverage of the coating arises partly from the geometry of the chamber which tends to a comparatively high aspect ratio (e.g., depth:width 5:1 or higher) and makes parts of these surfaces relatively inaccessible to the vapour deposition. The high aspect ratio also restricts the choice of materials which can be used to provide an effective passivation coating.

Existing passivation coatings are relatively thick as compared to the metal electrodes in order to reduce the likelihood of penetration of the fluid. This has the effect of restricting the width of the chambers (e.g., 65 μm) as well as efficient utilisation of space within the droplet deposition head.

However, a significant variation in coverage of the coating remains and fluids, especially if aqueous, are often still able to penetrate the coating and corrode the electrodes when the droplet deposition head is operated.

Another problem arises because the manufacture of the droplet deposition head may provide for cutting of the droplet ejection nozzles in the nozzle plate after a parylene passivation coating has been applied to the chamber walls and/or electrodes of the piezoelectric ceramic body.

The cutting uses a laser, for example, an ultra-violet laser beam, which tends to ablate the parylene coating. This can result in an aperture in the parylene coating so exacerbating the problem of penetration of the fluid and restricting the lifetime of the droplet deposition head.

A further problem arises in that the material of the passivation coating can be damaged by certain fluids, especially aqueous fluids and those having a high (e.g., 9.0 or above) or low pH (e.g., 4.0 or below). This also exacerbates the problem of penetration of the fluid and restricts the lifetime of the droplet deposition head.

The problem of penetration of fluid is not, therefore, satisfactorily solved by a passivation coating comprising a relatively thick, single insulating layer of an organic material or even by a passivation coating comprising multiple insulating layers of an inorganic material deposited by vapour deposition.

The present inventors now provide a droplet deposition head comprising an improved passivation coating which is based upon an insulating layer of an inorganic material and an insulating layer of an organic material which have been deposited by two different low temperature techniques (e.g., below 150° C.).

Although the use of a low temperature technique tends to result in a higher density of defects in an insulating layer, the use of a different material and a different low temperature technique for each insulating layer means that the defects do not align at the interface between the layers.

The passivation coating consequently defines a much longer pathway for migration of ionic species in a fluid to the electrode as compared to a coating comprising a single insulating layer of organic material or one comprising multiple insulating layers of inorganic material deposited by vapour deposition.

US 2001/0052752 A1 discloses a coating comprising a layer of aluminium oxide and a layer of a parylene which are deposited by different low temperature techniques. The coating encapsulates an organic light emitting diode (OLED) in order to protect it against ingress of water and oxygen from the environment.

Bülow H. G. et al., disclose, in Nanoscale Research Letters, 2014, 9, 223, a coating suitable for OLED encapsulation comprising multiple layers of aluminium oxide and a parylene which are deposited by different low temperature techniques. The moisture barrier properties of the coating are discussed.

These disclosures are not concerned with droplet deposition heads and do not teach or suggest a coating suitable for passivation of an electrode in a droplet deposition head that is resistant to field assisted penetration of ionic species.

U.S. Pat. No. 8,240,819 B2 discloses a coating for an electrode in an inkjet printhead which comprises a layer of silicon dioxide and a layer of parylene which are deposited by different low temperature techniques. The silicon dioxide layer is said to protect the electrode from corrosion after the partial laser ablation of the parylene layer—provided that the parylene layer has a thickness of at least 3 μm.

The present inventors have found that a passivation coating comprising an insulating layer of an inorganic material and an insulating layer of an organic material which are deposited by different low temperature techniques on an electrode in a droplet deposition head can resist field (e.g., around 1 $V\mu m^{-1}$) driven migration of ionic species when the droplet deposition head is operated.

The present inventors have also found that the passivation coating can be comparatively thin and, in particular, comprise an insulating layer of organic material which has thickness less than 3 μm.

Accordingly, in a first aspect, the present disclosure provides a droplet deposition head having a fluid chamber connected to a droplet ejection nozzle and to a reservoir for the fluid, and a piezoelectric actuator element formed at least in part by a fluid chamber wall having an electrode thereon, which element is displaceable in response to a drive voltage to generate a pressure in the chamber to eject a droplet of fluid from the chamber through the nozzle wherein the electrode is provided with a passivation coating which comprises, at least in part, a laminate comprising an inorganic insulating layer nearest to or contacting an electrode and an organic insulating layer overlying the inorganic insulating layer wherein defects in the insulating layers are misaligned at the interface there between and wherein the inorganic insulating layer has thickness less than or equal to 500 nm and the organic insulating layer has a thickness less than 3 μm.

Note that the deposition head may have a plurality of fluid chambers and a plurality of piezoelectric actuator elements and that each piezoelectric actuator element may be formed in part by a chamber wall having the electrode thereon (see, for example FIG. 1). Consequently, a fluid chamber may comprise chamber walls which are, for example, opposing walls each having an electrode thereon. In that case, each of the electrodes in a fluid chamber may be provided with the passivation coating.

In one embodiment, the inorganic insulating layer is a layer which has been deposited by atomic layer deposition (ALD) at a temperature below 150° C., in particular, at a temperature of 120° C. or below, for example, at or below 110° C.

An inorganic insulating layer deposited by ALD fills out pinholes and bridges nanoscale cracks in an underlying surface. An inorganic insulating layer deposited on or nearest to the electrode by this technique is less likely to propagate defects as compared to an organic insulating layer which has to be deposited by another technique.

The organic insulating layer may be a layer which has been deposited by plasma enhanced chemical vapour deposition (PECVD) at a temperature below 150° C., in particular, at a temperature of 120° C. or below, for example, at or below 110° C.

However, it may also be a layer which has been deposited by any suitable technique other than ALD which can employ these temperatures. Suitable techniques include chemical vapour deposition and, in particular, molecular layer deposition (MLD).

Suitable inorganic materials for the inorganic insulating layer comprise amorphous metal oxides, metal nitrides and metal carbides as well as allotropes of carbon, such as diamond-like-carbon (DLC).

The optimum thickness of an inorganic layer will depend on the precise nature of the inorganic material and, in particular, the desired breakdown voltage of the inorganic insulating layer.

In one embodiment, the inorganic insulating layer comprises amorphous silicon nitride and has thickness of between 20 nm and 500 nm, for example, 50 nm, 100 nm, 200 nm, 300 nm or 400 nm.

In another embodiment, the inorganic insulating layer comprises an amorphous metal oxide, in particular, one or more of an amorphous metal oxide selected from the group consisting of amorphous $SiO_2$, $Al_2O_3$, $TiO_2$, $ZrO_2$, MgO, $Ta_2O_5$ and $HfO_2$.

In this embodiment, the inorganic insulating layer may have a thickness below 100 nm, for example, 75 nm, 70 nm, 60 nm, 50 nm, 45 nm or less.

The inorganic insulating layer may comprise an inorganic material which has a high relative electric permittivity as compared to that of $SiO_2$ (at the same frequency). A high K material inhibits field assisted diffusion of ionic species by reducing induced voltages and improves the breakdown performance of the inorganic insulating layer as compared to an inorganic insulating layer comprising silica.

The inorganic insulating layer may comprise an inorganic material which exhibits broader pH resistance as compared to $Al_2O_3$. Amorphous $Al_2O_3$ has been found to be more susceptible to high and low pH as compared to some other metal oxides.

Hafnia ($HfO_2$) has a particularly high relative electric permittivity as compared to $SiO_2$ and has been found to have excellent chemical robustness over an extended pH range as compared to $Al_2O_3$ at comparable layer thicknesses.

In one embodiment, therefore, the inorganic insulating layer comprises amorphous $HfO_2$. In this embodiment, the $HfO_2$ layer may have a thickness greater than or equal to 45 nm and less than 100 nm. The breakdown voltage of an $HfO_2$ layer of thickness 45 nm, for example, is high (e.g., 4.9 MV/cm) and uniform across the layer as compared to that of an $HfO_2$ layer of lesser thickness (a 22 nm thick $HfO_2$ layer, for example, shows a non-uniform breakdown voltage which is as low as 1.5 MV/cm at some locations).

The insulating organic layer may comprise any suitable organic material providing a conformal and uniform insulating organic layer by the chosen technique. It may, in particular, comprise an organic polymer, especially a parylene, for example, parylene N, C or D.

The optimum thickness for an organic insulating layer will depend on the nature of the organic material. The insulating organic layer may have a thickness of less than 50 nm provided that the layer is a continuous layer. Generally, however it has a thickness between 50 nm and 2.5 μm, in particular, between 50 nm and 2.0 μm, for example, 1.5 μm, or 1.2 μm or 1.0 μm.

In one embodiment, the organic insulating layer comprises a layer of parylene C deposited by PECVD at room temperature and has thickness 1.2 μm or below, for example 1.0 μm. In this embodiment, the inorganic insulating layer may, in particular, comprise an $HfO_2$ layer of thickness 45 nm but other thicknesses below 100 nm may also be used.

In some embodiments, the inorganic insulating layer contacts the electrode. In other embodiments, the passivation coating further comprises a buffer or seed layer which contacts the electrode and the inorganic insulating layer is provided on the buffer or seed layer.

The buffer or seed layer comprises an insulating material which provides a smoother surface as compared to that of the electrode so as to ensure a more conformal and uniform deposition of the inorganic insulating layer and good adhesion.

The buffer or seed layer may, in particular, comprise an inorganic insulating material. It may comprise any of the amorphous metal oxides mentioned above and may be formed by ALD at a temperature below 150° C., in particular, at 120° C. or 110° C. or below.

The thickness of the buffer or seed layer can be considerably less than the thickness of the inorganic insulating layer. The buffer or seed layer may, in particular, be a monolayer. It may have thickness from 2 nm to 20 nm, for example 15 nm, 10 nm or 5 nm or below. In one embodiment, the buffer or seed layer comprises an insulating layer of amorphous $Al_2O_3$ of thickness 10 nm.

The electrode may, in particular, comprise a metal such as nickel, silver, copper, or gold or a metal alloy such as nichrome. The electrode may have a thickness of 1.0 μm to 5.0 μm, for example, 4.5 μm or 3.0 μm.

The electrode may be an electrode which has been treated (for example, by $O_2$ plasma) so as to promote adhesion of the first inorganic insulating layer or the seed or buffer layer.

In one embodiment, the electrode comprises nickel (which may already have a surface layer of nickel oxide formed by natural oxidation).

The present disclosure also encompasses a passivation coating in which the laminate comprises more than one inorganic insulating layer and, optionally, more than one organic insulating layer.

Note that each inorganic insulating layer has a thickness less than or equal to 500 nm and each organic insulating layer has a thickness less than 3 μm.

Note also that each inorganic insulating layer is a layer which has been deposited by atomic layer deposition (ALD) at a temperature less than or equal to 150.0 and that each organic insulating layer is a layer which may be deposited by plasma enhanced chemical vapour deposition (PECVD) or one of a variety of suitable techniques at a temperature less than or equal to 150° C.

Note further that the laminate should have an arrangement of inorganic insulating layers and organic insulating layers which is alternate viz. a majority of organic insulating layers are sandwiched between inorganic insulating layers.

A passivation coating comprising such a laminate provides a longer pathway for migration of ionic species to the electrode as compared to a passivation coating having only one of each insulating layer.

In some embodiments, the laminate comprises two, three, four or five inorganic insulating layers and two, three, four or five organic insulating layers.

The inorganic insulating layers may comprise the same or a different inorganic material and the organic insulating layers may also comprise the same or a different organic material.

The inorganic insulating layers may have the same or different thickness and, in particular, any of one of the thicknesses mentioned above in relation to the inorganic insulating layer. The organic insulating layers may also have the same or different thickness and, in particular, any one of the thicknesses mentioned above in relation to the organic insulating layer.

In one embodiment, an inorganic insulating layer is provided in the laminate as a top insulating layer. In this embodiment, the uppermost organic insulating layer may be protected from laser ablation during the manufacture of the droplet deposition head.

In another embodiment, an organic insulating layer is provided in the laminate as a top insulating layer. In this embodiment, the top organic insulating layer is exposed (in part) to laser ablation during the manufacture of the droplet deposition head, but the laser-damaged passivation coating still provides a longer pathway for migration of ionic species to the electrode as compared to a laser-damaged passivation coating comprising one inorganic insulating layer and one organic insulating layer.

In these embodiments, each of the inorganic insulating layers may comprise amorphous $HfO_2$ and have a thickness of 45 nm and each of the organic insulating layers may comprise parylene C and have thickness of 1.5 μm or less, for example, 1.2 μm or 1.0 μm.

In some embodiments, one or more inorganic insulating layers are layers which have been formed or treated to promote adhesion of an organic insulating layer.

The one or more inorganic insulating layers may, in particular, be layers which have been formed from a mixture of inorganic materials, such as the metal oxides mentioned above, and/or layers which have been formed with a gradient in composition in the thickness direction of the layer. The mixture and/or gradient may be chosen so that it optimises adhesion to a lower and/or an upper organic insulating layer.

Alternatively, the one or more inorganic insulating layers may be layers which have been treated with a silane (for example, A-174) by chemical vapour deposition or from a solution at a temperature below 150° C., in particular, at or below 120° C. or 110° C. It has been found that parylene C has a better adhesion to an $HfO_2$ insulating layer that has been so treated as compared to an $HfO_2$ layer which has been untreated.

In some embodiments, the one or more organic insulating layers may be layers which have been treated to promote adhesion to an inorganic layer (by, for example, exposure to an $O_2$ plasma).

In one embodiment, the passivation coating further comprises an electroless metal layer. The electroless metal layer may be provided on the laminate and/or within the laminate as an energy dissipating layer mitigating the effect of the laser beam used for cutting nozzles on the underlying organic insulating layers. It may also be provided so that the coating acts (as a Faraday buffer) to lower the electric field in the chamber when the droplet deposition head is operated.

The electroless metal layer may be deposited (at a temperature less than or equal to 150° C.) by electroless plating or by any other suitable method not requiring an electric current to form a metal deposit (for example, a physical vapour deposition process).

The electroless metal layer may, in particular, comprise electroless nickel, silver, copper, gold (alone or in combination) or nichrome and have thickness up to 5.0 μm, for example, 2.0 μm, 1.0 μm, 0.5 μm or less.

In one such embodiment, an electroless nickel layer is provided on the laminate and an electroless gold layer is provided on the electroless nickel layer.

The overall thickness of the passivation coating may, in particular, be between 0.2 μm and 10 μm. For example, it is between 0.2 μm and 5.0 μm.

In one embodiment, in which the laminate comprises a laminate of two $HfO_2$ layers and two parylene C layers, the overall thickness of the passivation coating can be less than 2.5 μm. This compares well with prior art passivation coatings in droplet deposition heads and enables better utilisation of space within the droplet deposition apparatus.

The droplet deposition head may be an inkjet printhead, in particular, a drop-on-demand inkjet printhead.

In a second aspect, the present disclosure provides a method for the manufacture of a droplet deposition head having a fluid chamber connected to a droplet ejection nozzle and to a reservoir for the fluid, and a piezoelectric actuator element formed at least in part by a fluid chamber wall having an electrode thereon, which element is displaceable in response to a drive voltage to generate a pressure in the chamber to eject a droplet of fluid from the chamber through the nozzle, wherein the method comprises forming a passivation coating on the electrode by depositing an inorganic insulating layer of thickness less than or equal to 500 nm on or over an electrode using a first deposition technique at a temperature less than or equal to 150° C. and depositing an organic insulating layer of thickness less than 3 μm on the inorganic insulating layer using a second deposition technique at a temperature below 150° C. which is a different technique to that of the first deposition technique.

In one embodiment, the method comprises depositing the inorganic insulating layer using atomic layer deposition (ALD) at a temperature below 150° C., in particular, at 120° C. or 110° C. or below.

In this embodiment, the method may comprise depositing the organic insulating layer using plasma enhanced chemical vapour deposition (PECVD) at a temperature below 150° C., in particular, at 120° C. or 110° C. or below.

However, it may alternatively comprise depositing the organic insulating layer by any other suitable technique at these temperatures.

In one embodiment, the method comprises depositing silicon nitride as the inorganic insulating layer to a thickness between 20 nm and 500 nm, for example, 50 nm, 100 nm, 200 nm, 300 nm or 400 nm.

In another embodiment, the method comprises depositing an amorphous metal oxide as the inorganic insulating layer to a thickness less than 100 nm, for example, 80 nm, 70 nm, 60 nm, 50 nm, 45 nm or less. In this embodiment, the amorphous metal oxide may be selected from the group consisting of $SiO_2$, $Al_2O_3$, $TiO_2$, $ZrO_2$, MgO, $Ta_2O_5$ and $HfO_2$.

The method may, in particular, deposit a metal oxide which has a high relative electric permittivity as compared to $SiO_2$ (at the same frequency). The metal oxide may also exhibit a broader pH resistance as compared to aluminium oxide.

In one embodiment, therefore, the method comprises depositing an inorganic insulating layer comprising amorphous $HfO_2$. to a thickness between 45 nm and 100 nm.

The method may employ any organic material which is suitable for forming an organic insulating layer which is a conformal layer of uniform distribution by the chosen technique. It may, in particular, employ an organic polymer such as a parylene, for example parylene N, C or D.

In one embodiment, the method comprises depositing an organic insulating layer comprising parylene C to a thickness up to 2.5 μm, for example, between 50 nm and 2.5 μm, and in particular, to 2.0 μm, 1.5 μm, 1.2 μm or 1.0 μm.

In some embodiments, the method comprises depositing the inorganic insulating layer directly on to the electrode. In other embodiments, the method comprises depositing a buffer or seed layer on to the electrode prior to depositing the inorganic insulating layer.

The method may, in particular, comprise depositing a buffer or seed layer of an inorganic insulating material using atomic layer deposition (ALD) at a temperature below 150° C., for example at 120.0 or 110.0 or below.

The method may deposit any of the amorphous metal oxides mentioned above as the buffer or seed layer and to a thickness of 5 nm to 20 nm, for example, 10 nm. In one embodiment, the method comprises depositing a buffer or seed layer comprising amorphous $Al_2O_3$ to a thickness of 10 nm.

The metal electrode may, in particular, comprise a layer of copper, nickel, silver, gold or nichrome of thickness 1.0 μm to 5.0 μm, for example, 4.5 μm or 3.0 μm.

In one embodiment, the method comprises depositing more than one inorganic insulating layer and, optionally more than one organic insulating layer.

Note that the method deposits each inorganic layer to a thickness less than or equal to 500 nm and each organic insulating layer less than 3 μm.

Note also that the method may deposit each of the inorganic insulating layers by atomic layer deposition (ALD) at a temperature below 150.0 and each of the organic insulating layers by plasma enhanced chemical vapour deposition (PECVD) or one of a variety of suitable techniques at a temperature below 150° C.

Note further that the method comprises depositing the insulating layers so that the inorganic insulating layers and the organic insulating layers alternate viz., so that at least one organic insulating layer is disposed between and contacts two inorganic insulating layers.

The method may, in particular, comprise depositing two, three, four or five inorganic insulating layers and two, three, four or five organic insulating layers.

In one such embodiment, the method comprises depositing an inorganic insulating layer as a top insulating layer. In another such embodiment, the method comprises depositing an organic insulating layer as a top insulating layer.

The method may comprise depositing inorganic insulating layers comprising the same or a different inorganic material and depositing organic insulating layers comprising the same or a different organic material.

The method may deposit inorganic insulating layers of the same or a different thickness and/or organic insulating layers of the same or a different thickness.

In these embodiments, the method may comprise depositing each of the inorganic insulating layers as a layer of amorphous $HfO_2$ and to a thickness of 45 nm as well as depositing each of the organic insulating layers as a layer of parylene C to a thickness of 1.0 μm or 1.2 μm.

In some embodiments, the method further comprises forming one or more inorganic insulating layers form a mixture of inorganic materials such as the metal oxides mentioned above and/or with a gradient in composition in the thickness direction of the layer. The mixture and/or gradient may be chosen so that optimises adhesion to a lower and/or an upper organic insulating layer.

In other embodiments, the method further comprises treating one or more (for example, all) inorganic insulating layers prior to forming an organic insulating layer so as to promote adhesion of the organic insulating layer.

In these embodiments, the method may comprise treating the one or more inorganic insulating layer with a silane (for example, A-174) by chemical vapour deposition or from a solution at a temperature at or below 150° C., in particular, at or below 120° C. or 110° C.

In some embodiments, the method further comprises treating the one or more organic insulating layers (for example, all) prior to forming an organic insulating layer to promote adhesion of the inorganic insulating layer. The method may, for example, comprise treating the one or more organic insulating layers with an $O_2$ plasma at a temperature below 150° C., in particular, at or below 120.0 or 110° C.

In some embodiments, the method further comprises depositing a metal layer by electroless plating or any other method not requiring an electric current to form a metal deposit at a temperature below 150° C., in particular, at 120° C. or 110° C. or below.

The method may deposit a nickel, silver, copper, gold (alone or in combination) or nichrome layer of thickness up to 5.0 um, for example, 2.0 μm, 1.0 μm, 0.5 μm or less, on a top insulating layer or between inorganic and organic insulating layers. For example, the method deposits the electroless metal layer on an inorganic insulating layer.

The method may, in particular, comprise depositing an electroless nickel layer on a top insulating layer and depositing an electroless gold layer on the electroless nickel layer. It may also comprise depositing a layer of an electroless metal on an inorganic insulating layer (or an organic insulating layer) and depositing an organic insulating layer (or an inorganic insulating layer) on the electroless metal layer.

The method may provide an inkjet printhead, in particular, a drop-on-demand inkjet printhead.

In a third aspect, the present disclosure provides a droplet deposition apparatus including the droplet deposition head according to the first aspect.

In a fourth aspect, the present disclosure provides a method for the manufacture of droplet deposition apparatus comprising making a droplet deposition head according to the second aspect.

In a fifth aspect, the present disclosure provides for use, in a droplet deposition head having a fluid chamber connected to a droplet ejection nozzle and to a reservoir for the fluid, and a piezoelectric actuator element formed at least in part by a fluid chamber wall having an electrode thereon, which element is displaceable in response to a voltage to generate a pressure in the chamber to eject a droplet of fluid from the chamber through the nozzle, of a passivation coating comprising a laminate providing an inorganic insulating layer nearest to or contacting the electrode and having an organic insulating layer overlying the inorganic insulating layer wherein the layers are substantially free from aligned defects at the interface between layers and wherein the inorganic insulating layer has thickness less than or equal to 500 nm and the organic insulating layer has a thickness less than 3 μm.

In a sixth aspect, the present disclosure provides a method for the passivation of fluid chamber walls of a bulk piezoceramic droplet deposition head by depositing a passivation coating on the fluid chamber walls, wherein the method comprises depositing an inorganic insulating layer of thickness less than 100 nm on the fluid chamber walls using a first deposition technique at a temperature no greater than 150.0 and depositing an organic insulating layer of thickness less than 3 μm on the inorganic insulating layer using a second deposition technique at a temperature no greater than 150.0 which is a different technique to that of the first deposition technique.

Embodiments of the third, fourth, fifth and sixth aspects of the present disclosure will be apparent from those described in relation to the first and second aspects.

Embodiments will now be described in some detail with reference to the Examples and to the accompanying Drawings in which.

Figure 1:
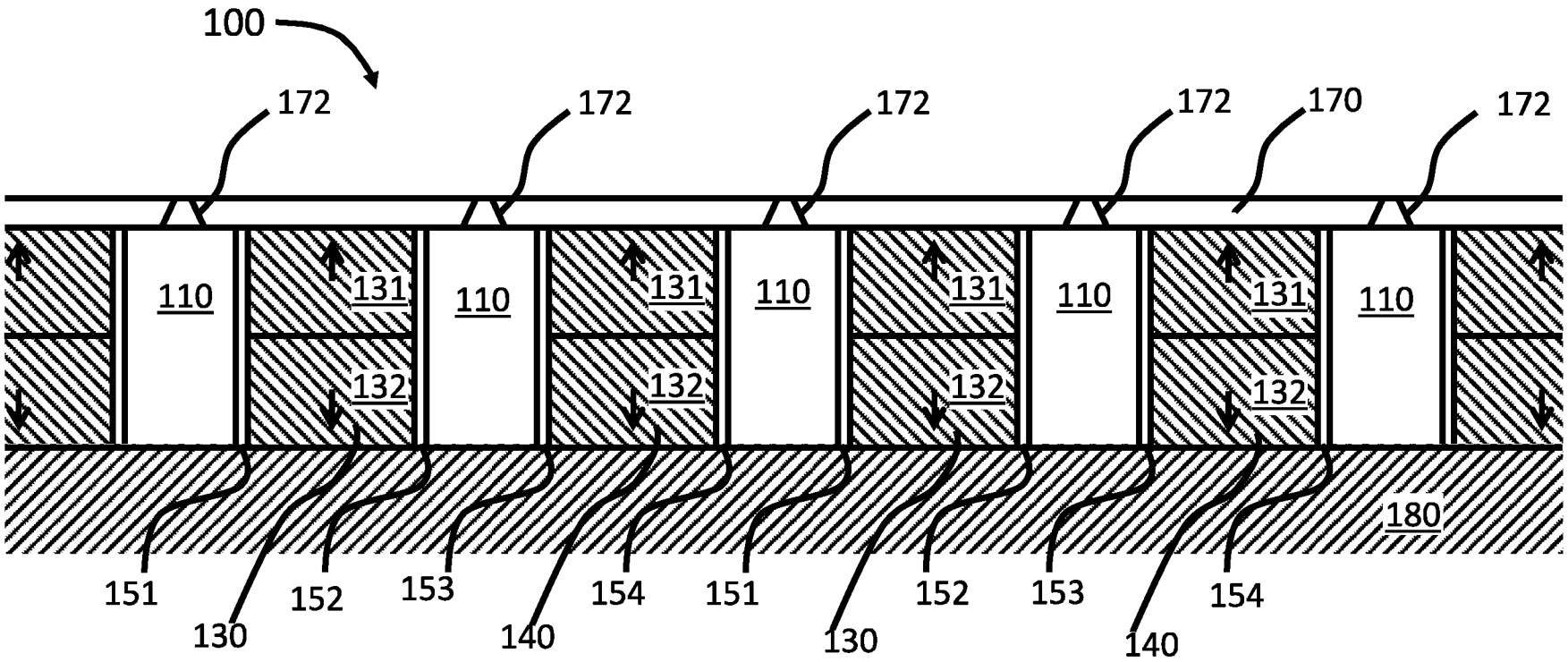
FIG. 1 shows a droplet deposition head which may be adapted by a passivation coating to a droplet deposition head according to one embodiment.
Figure 2:
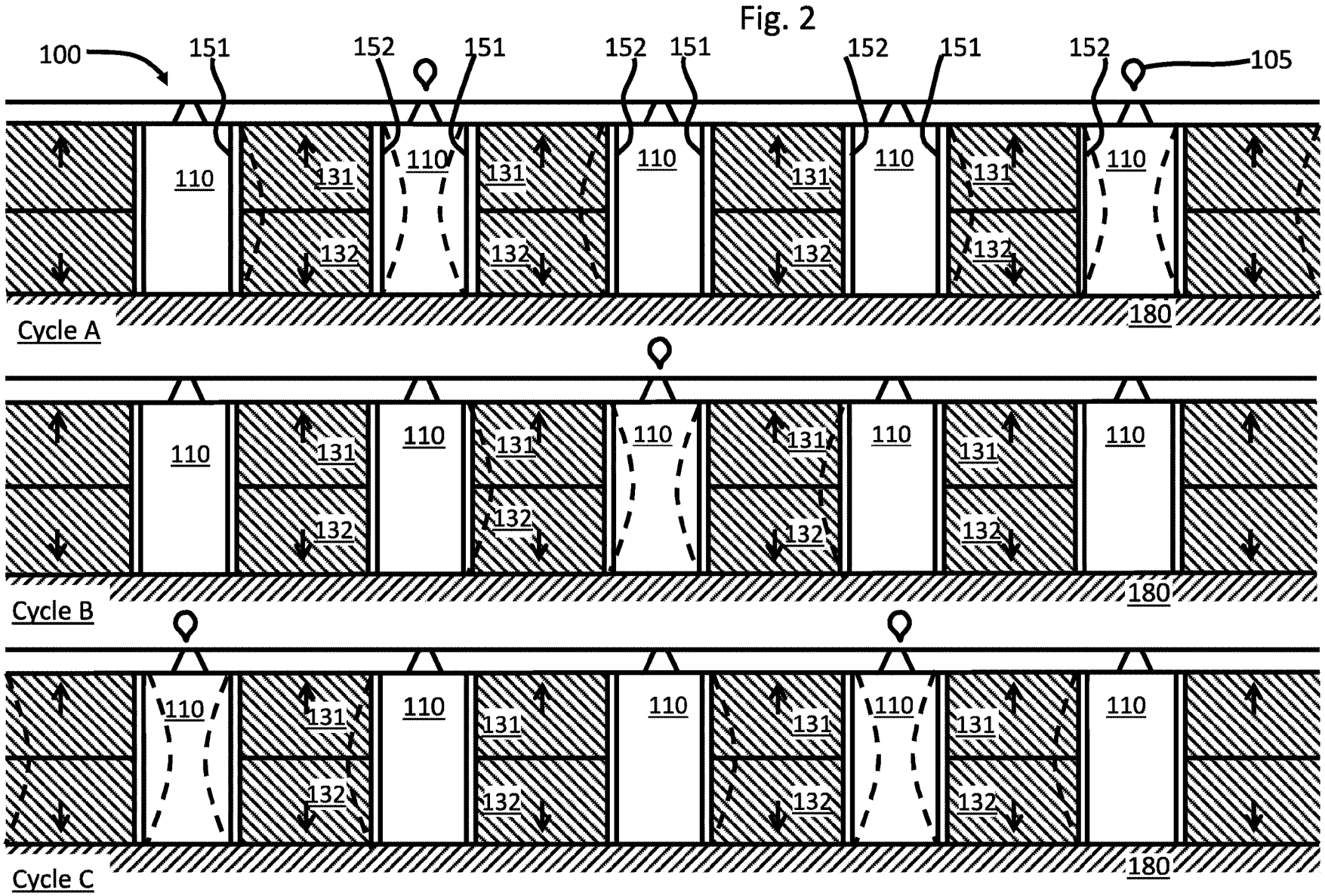
FIG. 2 shows a cyclic firing in the droplet deposition head shown in FIG. 1.
Figure 3:
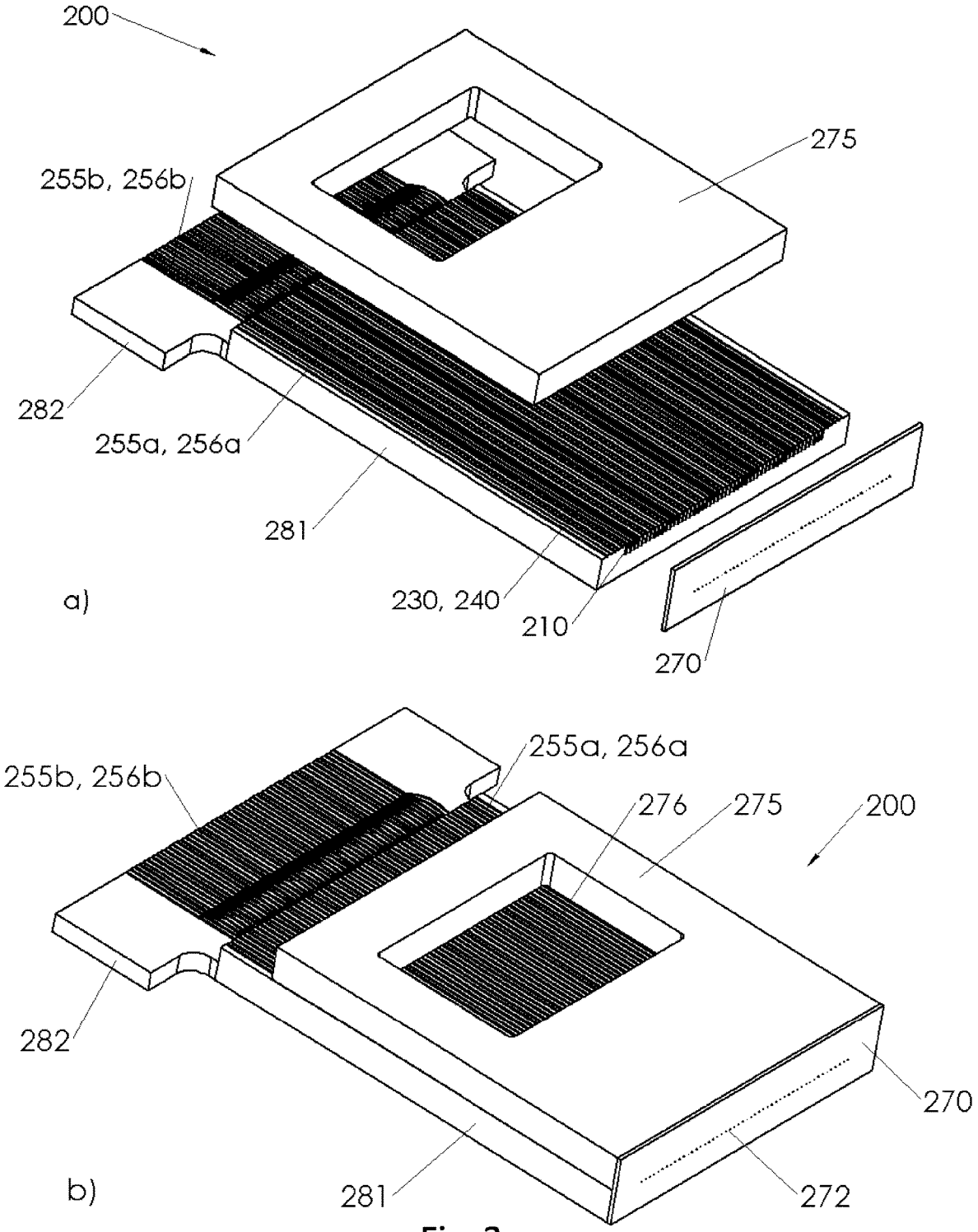
Figure 4:
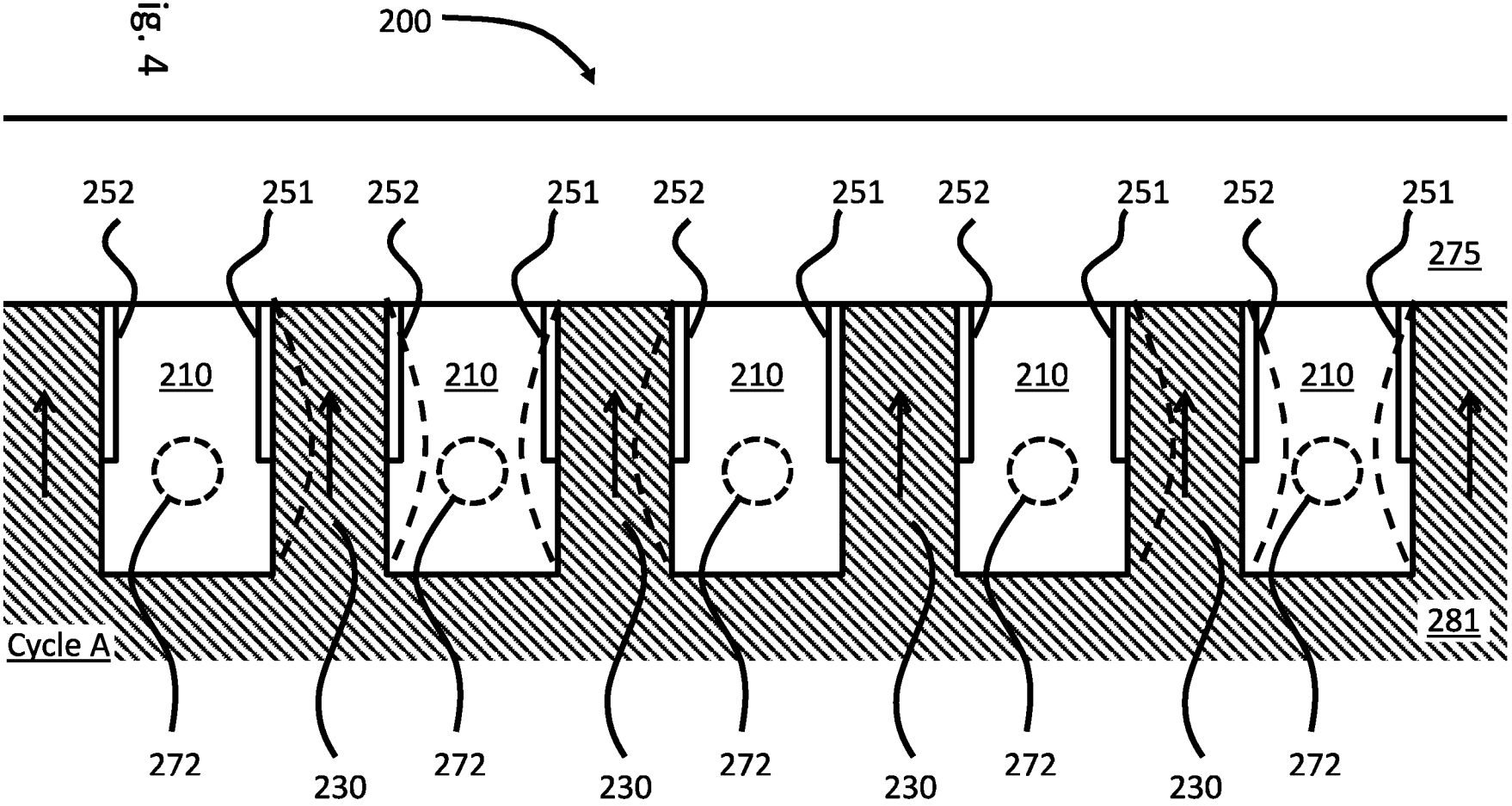
Figure 5:
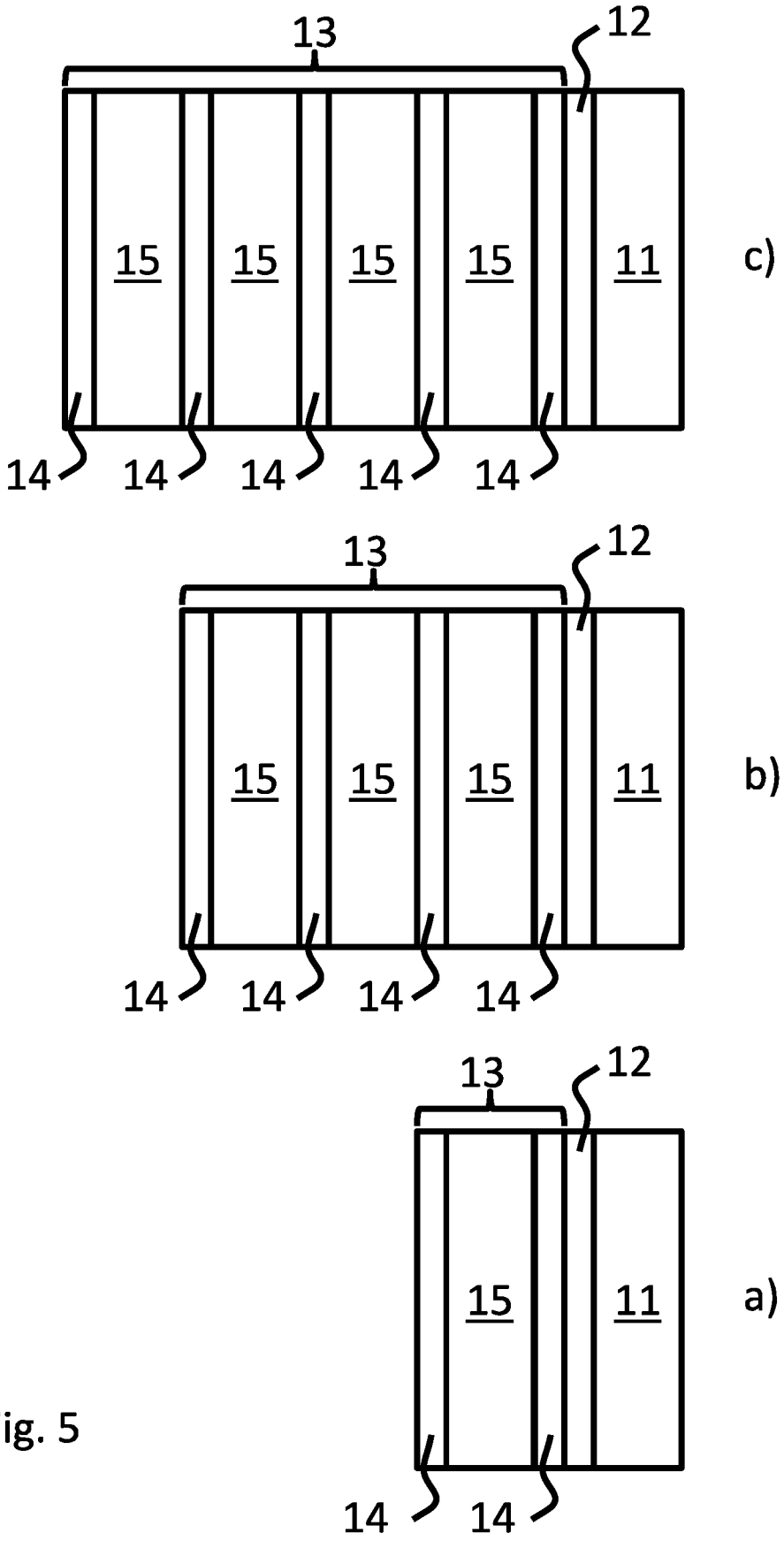
Figure 6:
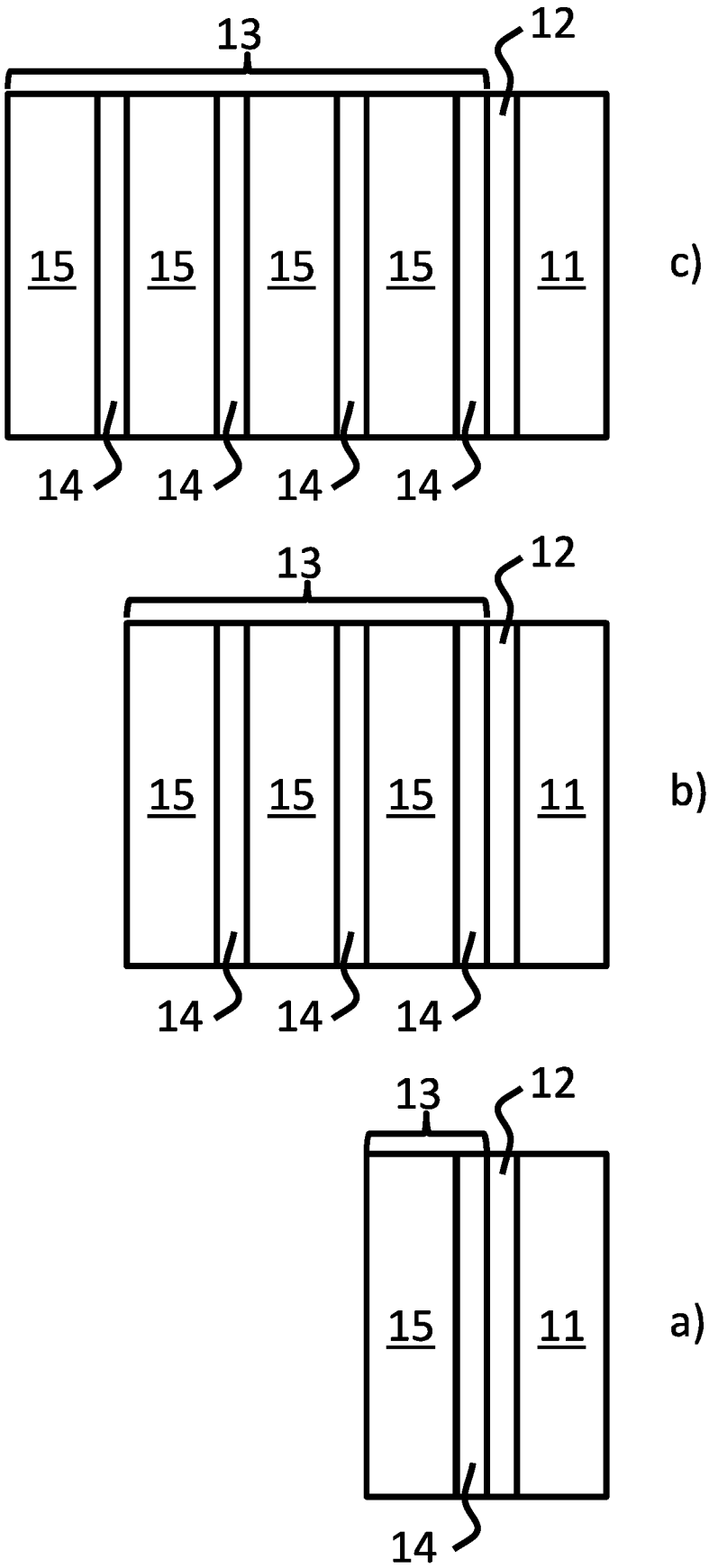
Figure 7:
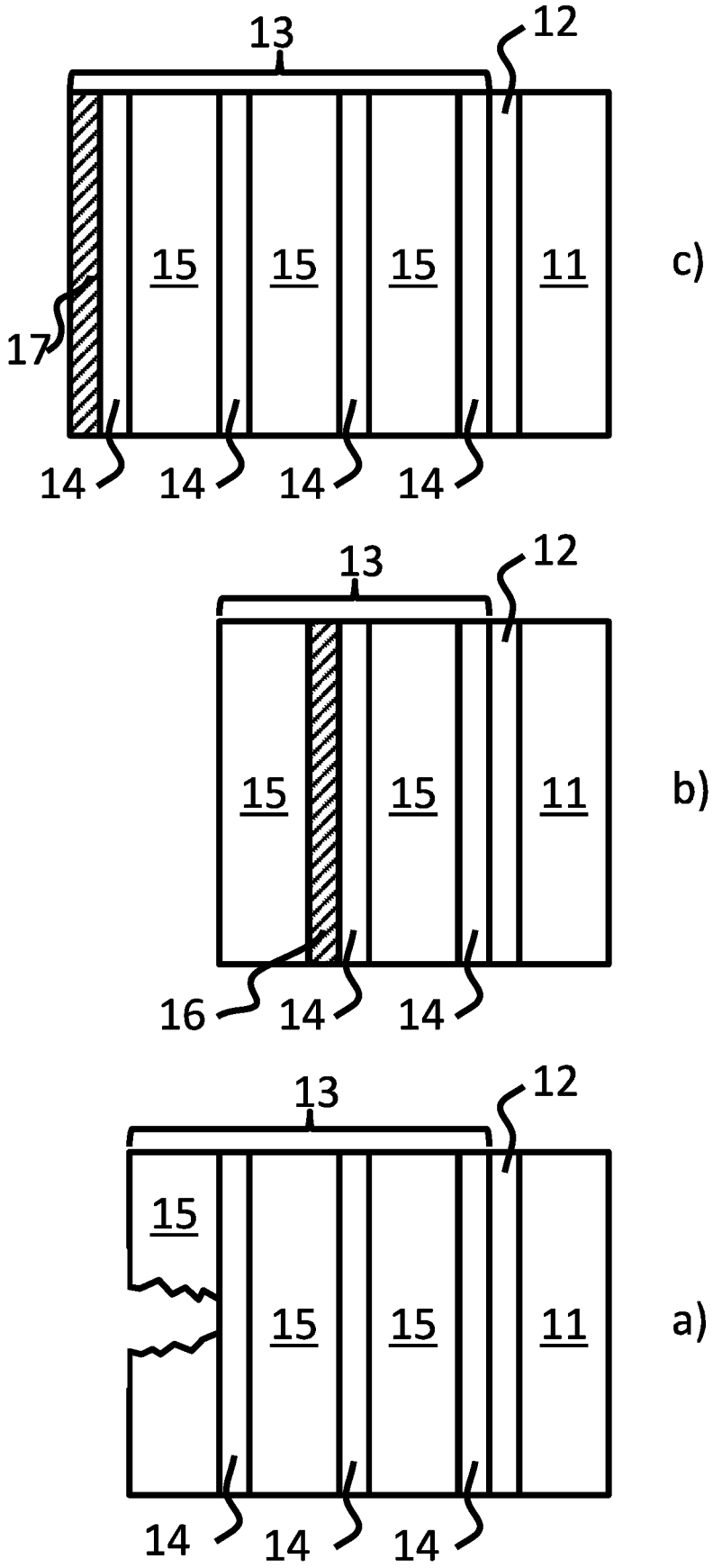
Figure 8:
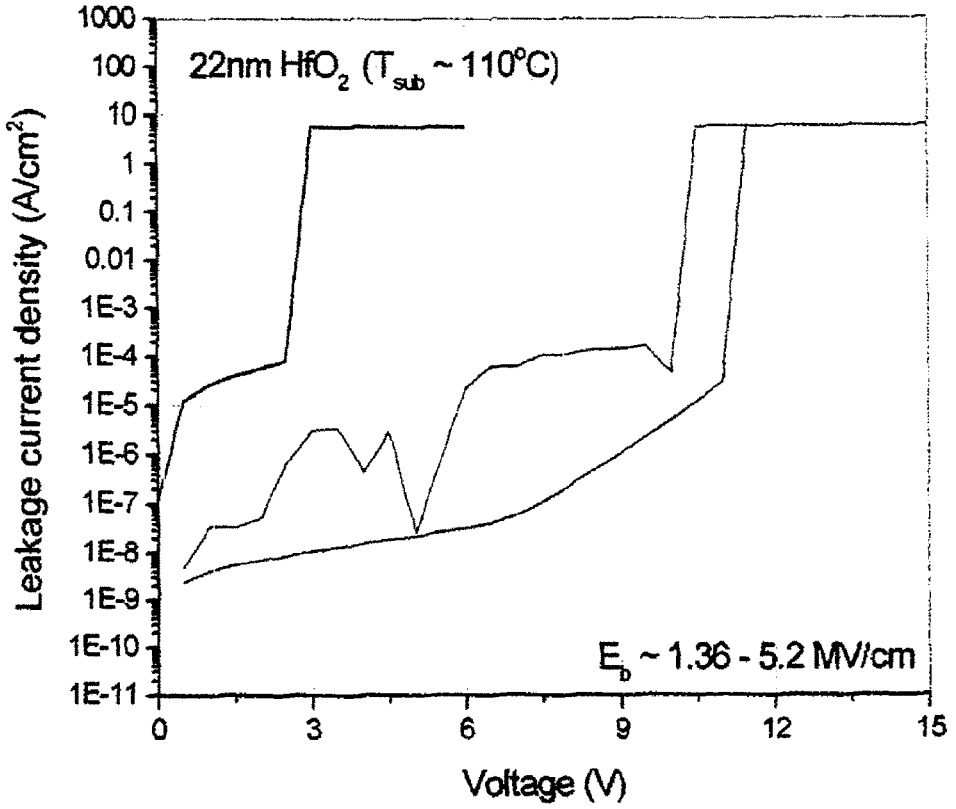
Figure 8:
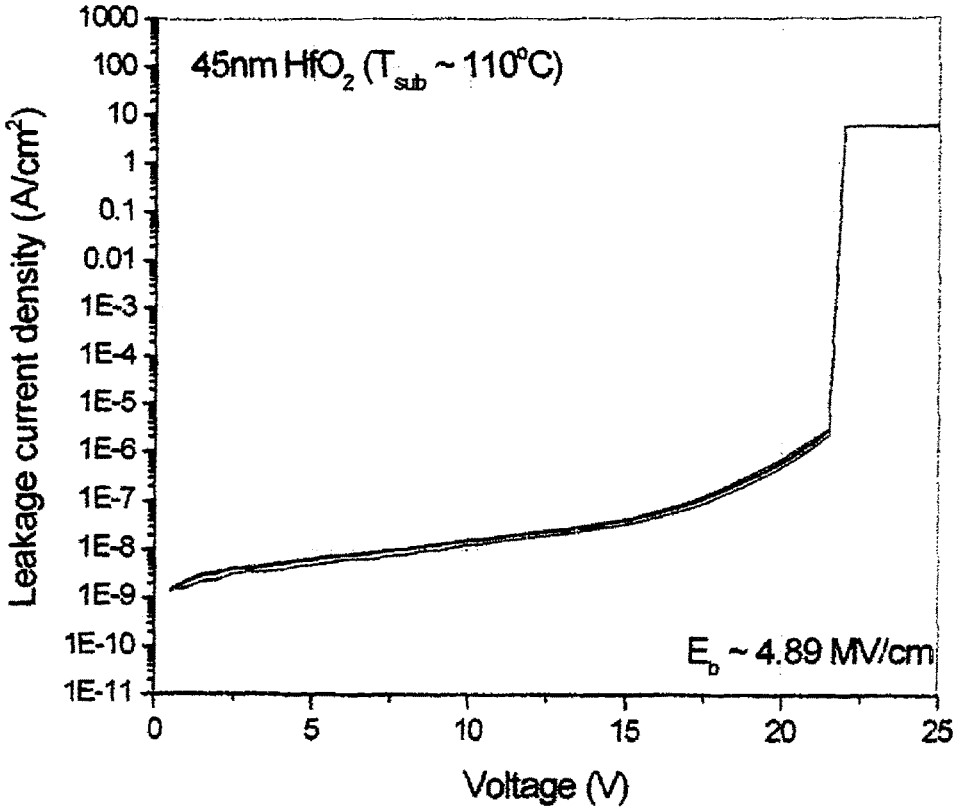

FIGS. 3 (*a*) and (*b*) and FIG. 4 show another droplet deposition head which may be adapted by a passivation coating to a droplet deposition head according to another embodiment;

FIGS. 5 *a*) to *c*) show passivation coatings according to several embodiments of the present disclosure;

FIGS. 6 *a*) to *c*) show passivation coatings according to several other embodiments of the present disclosure;

FIGS. 7 *a*) to *c*) show passivating coatings according to further embodiments of the present disclosure; and FIGS. 8 *a*) and *b*) are graphs plotting the current voltage response of single $HfO_2$ layers of different thickness on a nickel electrode.

Referring now to FIGS. 1 to 4, two droplet deposition heads which are discussed in detail above comprise electrodes layers which are in contact with fluid and may be adapted to droplet deposition heads according to the present disclosure by applying a passivation coating as described below in relation to FIGS. 5 to 8.

FIG. 5 is a schematic showing parts of several piezoelectric actuator elements, generally designated 10, in droplet deposition heads according to three embodiments of the present disclosure.

The piezoelectric actuator elements comprise a nickel electrode 12 which contacts a piezoceramic body 11 comprising lead zirconate titanate or other suitable piezoelectric material.

The piezoelectric actuator elements are each provided with a passivation coating, generally designated 13, which is a laminate of insulating layers of amorphous $HfO_2$ 14 and insulating layers of parylene C, 15.

The insulating layers of each laminate alternate so that a bottom insulating layer is a $HfO_2$ layer 14 which contacts the electrode 12 and the top insulating layer is a $HfO_2$ layer 14 which is exposed to ink.

The number of alternating insulating layers varies depending upon the balance between optimal protection from penetration of ink and optimal utilisation of available space.

FIG. 5 *a*) shows a laminate of two $HfO_2$ layers 14 and one parylene layer 15, FIG. 5 *b*) a laminate of four $HfO_2$ layers 14 and three parylene layers 15 and FIG. 5 *c*) a laminate of five $HfO_2$ layers 14 and four parylene layers 15.

In all these laminates, the thickness of each $HfO_2$ layer 14 is 45 nm and the thickness of the parylene layer 15 may be 1.0 μm, 1.2 μm or 1.5 μm.

FIG. 6 is a schematic showing parts of several piezoelectric actuator elements, generally designated 10, in inkjet printheads according to three other embodiments of the present invention.

The piezoelectric actuator elements comprise a nickel electrode 12 which contacts a piezoceramic body 11 comprising lead zirconate titanate or other suitable piezoelectric material.

The piezoelectric actuator elements are each provided with a passivation coating, generally designated 13, which is a laminate of insulating layers of amorphous $HfO_2$ 14 and insulating layers of parylene C, 15.

The insulating layers of each laminate alternate so that a bottom insulating layer is a $HfO_2$ layer 14 which contacts the electrode 12 and the top insulating layer is a parylene layer 15 which is exposed to a fluid such as an ink.

The number of alternating insulating layers varies depending upon the balance between optimal protection from penetration of the ink and optimal utilisation of available space.

FIG. 6 *a*) shows a laminate of one $HfO_2$ layer 14 and one parylene layer 15, FIG. 6 *b*) a laminate of two $HfO_2$ layers 14 and two parylene layers 15 and FIG. 6 *c*) a laminate of four $HfO_2$ layers 14 and four parylene layers 15.

In all these laminates, the thickness of each $HfO_2$ layer 14 is 45 nm and the thickness of the parylene layer 15 may be 1.0 μm, 1.2 μm or 1.5 μm.

FIG. 7 *a*) shows a part of a piezoelectric actuator element in a droplet deposition head according to another embodiment of the present disclosure. In this embodiment, the passivation coating comprises a laminate similar to those shown in FIG. 6. However, the number of the $HfO_2$ layers 14 is three and the number of the parylene layers 15 is three.

In this part, the top parylene layer 15 shows laser damage which exposes an underlying $HfO_2$ layer 14 to ink. The laminate, however, still provides an extended pathway for migration of ionic species to the electrode 12.

FIG. 7 *b*) shows part of a piezoelectric actuator element in a droplet deposition head according to another embodiment of the present disclosure. In this embodiment, the laminate is similar to that shown in FIG. 6 *b*) but includes a layer of electroless nickel 16 under the top parylene layer 15. The electroless nickel layer 16 acts as a light barrier to protect the underlying parylene layers from laser ablation during the laser cutting of the nozzles in the nozzle plate in the manufacture of the droplet deposition head.

FIG. 7 *c*) shows part of a piezoelectric actuator element in a droplet deposition head according to still another embodiment of the present disclosure. In this embodiment, the laminate is similar to that shown in FIG. 5 *b*) but includes a layer of electroless nickel 17 on the top $HfO_2$ layer 14. The electroless nickel layer 17 provides that the laminate acts as a Faraday buffer which shields the fluid chamber against the electric field generated when the printhead is operated.

EXAMPLE 1

A laminate of two $HfO_2$ layers and two parylene C layers (similar to FIG. 5 *b*)) was prepared on a nickel electrode deposited by electroless plating on a lead zirconate titanate substrate.

The substrate was pre-treated with an oxygen plasma generated by plasma ashing (Metroline M4L Plasma Asher; PVA Tepla America) of a helium-oxygen mixture (He 50 sccm; $O_2$ 150 sccm) at 400 W and 500 mTorr for 2 minutes.

An $HfO_2$ layer of 45 nm thickness was formed on the nickel electrode using a thermal atomic disposition system (ALD-150LE, Kurt J. Lesker Company) through cycles (362) of alternate exposure of the substrate (heated to 110° C.) to tetrakis(ethylmethyl)amino hafnium (TDMAH, 0.15, 10 seconds) and water (0.06, 20 seconds).

A silane coating (A-174) was applied to the $HfO_2$ layer using a chemical vapour deposition system (YES 1224P, Yield Engineering Systems Inc.) at 110° C., chamber pressure 0.8 Torr and exposure time 5 minutes.

A parylene polymer layer of thickness about 1.2 μm was formed on the coated $HfO_2$ layer using a plasma enhanced chemical vapour deposition system (SCS Labcoater® 2, Speciality Coating Systems Inc.) through exposure (at room temperature) of the substrate at chamber pressure 25 mTorr and to a parylene vapour obtained by vaporisation of parylene C at 690° C.

A second $HfO_2$ layer of thickness 45 nm was formed on the parylene layer using the same atomic layer deposition system and process conditions as for the first $HfO_2$ layer. After repeating the silane coating process for this $HfO_2$ layer, a second parylene polymer layer of thickness about 1.2 μm was formed on the second $HfO_2$ layer using the same plasma enhanced chemical vapour deposition system and process conditions as for the first parylene polymer layer.

Current voltage tests (IVT) were made on the substrate using an impedance measurement system (Keithley Picoammeter 6487) coupled to an electrochemical cell comprising the substrate and a graphite counter electrode in which portions of the laminate are exposed through O-rings of diameter 10 mm to MIMIC ink (an aqueous model fluid comprising nominal 70 v/v % water, water mixable co-solvents and 1 g/L electrolyte).

The leakage current of the laminate was determined to be less than $2\times10^{-9}$ A at applied voltages ranging from 0 to 60V—viz. at least an order of magnitude less than existing passivation coatings.

The impedance of the laminate was determined by electrical impedance spectroscopy (EIS, Voltalab® PGZ402; the cell including a working electrode, a graphite counter electrode and a Ag/AgCl reference electrode) at low frequency (e.g., $10^{-1}$ Hz to $10^{4}$ Hz) to be at least an order of magnitude higher than these prior art passivation coatings. Further, the impedance was the same before and after the current voltage tests.

EXAMPLE 2

The breakdown voltages of single $HfO_2$ layers formed at different thickness (22 nm and 45 nm) on a similar nickel electrode—lead zirconate titanate substrate by atomic layer deposition at 110° C. using the same atomic layer deposition system was examined by the aforementioned electrochemical cell (three O-rings).

As may be seen in FIG. 8, an IVT graph (a) for the 22 nm $HfO_2$ layer shows that the leakage current density and breakdown voltage is different at each location of exposure—and as low as 1.36 MV/cm. This and an inability to measure I-V more than 50% due to shorting suggest that the layer is not uniform.

The IVT graph (b) for the 45 nm $HfO_2$ layer shows that the leakage current density is the same at each location of exposure and as high as 4.89 MV/cm. The 45 nm $HfO_2$ layer is uniform and has more suitable electrical properties for forming a barrier layer against ink penetration.

The present disclosure provides a droplet deposition head having an improved passivation coating for the chamber walls and/or electrodes.

The multilayer passivation coating is highly resistant to field assisted penetration of ionic species and has lower thickness as compared to passivation coatings employed in prior art droplet deposition heads.

The multilayer passivation coating can show a good adhesion on the electrode and an adhesion between its layers which is sufficiently robust to mechanical stresses induced by distortion of the piezoceramic body when the droplet deposition head is operated.

The droplet deposition head can be used with a wider variety of fluids than those presently used. The fluids may be found within a broader pH range (from 3 to 10) and have higher ion conductivity (by two orders of magnitude) than those presently used.

The present disclosures provide, in particular, an inkjet printhead which has an increased operational lifetime as compared to prior art inkjet printheads.

Although embodiments have been described in relation to EP 0 364 136 B1 and EP 1 885 561 B1, other embodiments are possible which are not described here. The droplet deposition head may, for example, have a configuration which is different to those described in detail here and the passivation coating may include an inorganic material and/or organic material other than described in detail here.

Unless otherwise indicated a reference to a particular range of values (for example, layer thickness) includes the mentioned starting and finishing values.

Note further that it is the accompanying claims which point out the limits of the presently claimed invention. A reference in the accompanying claims to a droplet deposition head having a piezoelectric actuator element and a fluid chamber includes a reference to a plurality of such elements and chambers. Further, a reference to a fluid chamber wall having an electrode thereon includes a reference to two fluid chamber walls each having an electrode thereon.

The invention claimed is:

1. A droplet deposition head comprising:

a fluid chamber connected to a droplet ejection nozzle and to a reservoir for the fluid, and a piezoelectric actuator element formed at least in part by a fluid chamber wall comprising an electrode thereon, wherein the piezoelectric actuator element is displaceable in response to a drive voltage to thereby generate a pressure in the chamber to eject a droplet of fluid from the chamber through the nozzle, wherein:

the electrode is provided with a passivation coating which comprises, at least in part, a laminate comprising an inorganic insulating layer nearest to the electrode and an organic insulating layer overlying the inorganic insulating layer, defects in the inorganic and organic insulating layers are substantially misaligned at the interface between the inorganic and organic insulating layers, and the inorganic insulating layer has thickness less than or equal to 500 nm and the organic insulating layer has a thickness less than 3 μm.

2. A droplet deposition head according to claim 1, wherein the inorganic insulating layer has thickness less than or equal to 100 nm and the organic insulating layer has thickness less than or equal to 1.5 μm.

3. A droplet deposition head according to claim 1, wherein the laminate comprises more than one inorganic insulating layer and more than one organic insulating layer and at least one organic insulating layer is disposed between two inorganic insulating layers.

4. A droplet deposition head according to claim 3, wherein the laminate comprises two inorganic insulating layers and two organic insulating layers.

5. A droplet deposition head according to claim 3, wherein the laminate has a top insulating layer which is an organic insulating layer.

6. A droplet deposition head according to claim 5, wherein the top insulating layer comprises an aperture.

7. A droplet deposition head according to claim 1, wherein the passivation coating comprises an electroless metal layer disposed within or on the laminate.

8. A droplet deposition head according to claim 1, wherein the passivation coating comprises a buffer or seed layer provided on the electrode.

9. A droplet deposition apparatus comprising:

the droplet deposition head according to claim 1, wherein the passivation coating comprises a layer of an electroless metal on an inorganic insulating layer and an organic insulating layer on the electroless metal layer.

10. A method for the manufacture of a droplet deposition head comprising:

providing a fluid chamber connected to a droplet ejection nozzle and to a reservoir for the fluid, providing a piezoelectric actuator element formed at least in part by a fluid chamber wall having an electrode thereon, wherein the piezoelectric actuator element is displaceable in response to a drive voltage to thereby generate a pressure in the fluid chamber to eject a droplet of fluid from the fluid chamber through the nozzle, forming a passivation coating on the electrode by depositing an inorganic insulating layer of thickness less than 500 nm on or over an electrode using a first deposition technique at a temperature less than or equal to 150° C., and depositing an organic insulating layer of thickness less than 3 μm over the inorganic insulating layer using a second deposition technique at a temperature less than or equal to 150° C. which is a different technique to that of the first deposition technique.

11. A method according to claim 10, wherein the depositing of the inorganic insulating layer employs atomic layer deposition at a temperature equal to or below 110° C.

12. A method according to claim 11, wherein the depositing of the organic insulating layer employs plasma enhanced chemical vapor deposition at a temperature equal to or below 110° C.

13. A method according to claim 10, wherein the depositing of the organic insulating layer comprises depositing to a thickness of 1.0 μm or 1.2 μm or 1.5 μm.

14. A method according to claim 10, wherein the forming of the passivation coating comprises depositing more than one inorganic insulating layer and more than one organic insulating layer so that at least one organic insulating layer is disposed between two inorganic insulating layers.

15. A method according to claim 14, wherein the forming of the passivation coating comprises depositing an inorganic insulating layer as a top insulating layer.

16. A method according to claim 14, wherein the forming of the passivation coating comprises depositing an organic insulating layer as a top insulating layer.

17. A method according to claim 10, wherein the forming of the passivation coating comprises depositing a layer of an electroless metal on the top insulating layer.

18. A method according to claim 10, wherein the forming of the passivation coating comprises depositing a layer of an electroless metal on an inorganic insulating layer and depositing an organic insulating layer on the electroless metal layer.

19. A method according to claim 10, wherein the forming of the passivation coating comprises depositing a buffer or seed layer on to the electrode.

20. A method according to claim 10, which is a method for the manufacture of an inkjet printhead.

* * * * *